US010550829B2

(12) United States Patent
Wynohrad et al.

(10) Patent No.: US 10,550,829 B2
(45) Date of Patent: Feb. 4, 2020

(54) ION TRAJECTORY MANIPULATION ARCHITECTURE IN AN ION PUMP

(71) Applicant: Edwards Vacuum LLC, Sanborn, NY (US)

(72) Inventors: Anthony Wynohrad, Osage, IA (US); Joel Langeberg, Lonsdale, MN (US)

(73) Assignee: Edwards Vacuum LLC, Sanborn, NY (US)

( * ) Notice: Subject to any disclaimer, the term of this patent is extended or adjusted under 35 U.S.C. 154(b) by 181 days.

(21) Appl. No.: 15/259,424

(22) Filed: Sep. 8, 2016

(65) Prior Publication Data

US 2018/0068836 A1 Mar. 8, 2018

(51) Int. Cl.

| | |
|---|---|
| ***F04B 37/04*** | (2006.01) |
| ***F04B 37/14*** | (2006.01) |
| ***F04B 19/00*** | (2006.01) |
| ***H01J 41/12*** | (2006.01) |

(52) U.S. Cl.

CPC ..... *F04B 37/04* (2013.01); *F04B 19/006* (2013.01); *F04B 37/14* (2013.01); *H01J 41/12* (2013.01)

(58) Field of Classification Search

CPC ..... F04B 37/02; F04B 37/04; F04B 37/10; F04B 37/14; F04B 19/006; H01J 41/00–41/20; H01J 17/22–17/26

See application file for complete search history.

(56) References Cited

U.S. PATENT DOCUMENTS

| | | | | |
|---|---|---|---|---|
| 3,324,729 | A | 6/1967 | Vanderslice | |
| 3,452,923 | A * | 7/1969 | Lamont, Jr. | H01J 41/20 313/7 |
| 3,460,745 | A * | 8/1969 | Lamont, Jr. | H01J 41/20 313/7 |
| 4,631,002 | A * | 12/1986 | Pierini | H01J 41/20 204/298.01 |
| 5,655,886 | A * | 8/1997 | Alderson | F04B 37/02 313/309 |
| 6,004,104 | A * | 12/1999 | Rutherford | H01J 41/14 417/49 |
| 6,264,433 | B1 * | 7/2001 | Spagnol | H01J 41/12 417/48 |
| 6,498,344 | B1 * | 12/2002 | Littlejohn | H01J 41/18 250/283 |
| 6,835,048 | B2 * | 12/2004 | Perkins | H01J 41/18 335/306 |
| 9,960,026 | B1 * | 5/2018 | Hughes | H01J 41/14 |

(Continued)

FOREIGN PATENT DOCUMENTS

| | | |
|---|---|---|
| EP | 0106377 A2 | 4/1984 |
| EP | 3057121 A1 | 8/2016 |

OTHER PUBLICATIONS

Eckstein, Data from IPP Garching, at least as early as 2009.

(Continued)

*Primary Examiner* — Bryan M Lettman

(74) *Attorney, Agent, or Firm* — Westman, Champlin & Koehler, P.A.; Theodore M. Magee

(57) ABSTRACT

An ion pump includes an anode, a backing surface having at least one surface structure extending toward the anode and a cathode positioned between the anode and the backing surface and having an opening such that the at least one surface structure is aligned with and extends from the backing surface towards the opening.

15 Claims, 8 Drawing Sheets

(56) References Cited

U.S. PATENT DOCUMENTS

| | | | | |
|---|---|---|---|---|
| 2004/0120826 | A1* | 6/2004 | Perkins | H01J 41/18 417/48 |
| 2007/0286738 | A1* | 12/2007 | Lukens | F04B 37/02 417/49 |
| 2010/0034668 | A1* | 2/2010 | Cappuzzo | H01J 41/20 417/49 |
| 2016/0233050 | A1* | 8/2016 | Kasuya | H01J 37/18 |

OTHER PUBLICATIONS

European Communication dated Jan. 26, 2018 and Search Report dated Jan. 18, 2018 for corresponding European Application No. EP17187555.

Welch et al., Pumping of helium and hydrogen by sputter-ion pumps. I. Helium pumping, Journal of Vacuum Science & Technology: Part A, AVS/AIP, Melville, NY, US, vol. 11, No. 4, Part 1, pp. 1607-1613, Jul. 1, 1993.

* cited by examiner

ION TRAJECTORY MANIPULATION ARCHITECTURE IN AN ION PUMP

BACKGROUND

Ultra-high vacuum is a vacuum regime characterized by pressures lower than $10^{-7}$ pascal ($10^{-9}$ mbar, approximately $10^{-9}$ tor). Ion pumps are used in some settings to establish an ultra-high vacuum. In an ion pump, an array of cylindrical anode tubes are arranged between two cathode plates such that the openings of each tube faces one of the cathode plates. An electrical potential is applied between the anode and the cathode. At the same time, magnets on opposite sides of the cathode plates generate a magnetic field that is aligned with the axes of the anode cylinders.

The ion pump operates by trapping electrons within the cylindrical anodes through a combination of the electrical potential and the magnetic field. When a gas molecule drifts into one of the anodes, the trapped electrons strike the molecule causing the molecule to ionize. The resulting positively charged ion is accelerated by the electrical potential between the anode and the cathode toward one of the cathode plates leaving the stripped electron(s) in the cylindrical anode to be used for further ionization of other gas molecules. The positively charged ion is eventually trapped by the cathode and is thereby removed from the evacuated space. Typically, the positively charged ion is trapped through a sputtering event in which the positively charged ion causes material from the cathode to be sputtered into the vacuum chamber of the pump. This sputtered material coats surfaces within the pump and acts to trap additional particles moving within the pump. Thus, it is desirable to maximize the amount of sputtered material.

The discussion above is merely provided for general background information and is not intended to be used as an aid in determining the scope of the claimed subject matter. The claimed subject matter is not limited to implementations that solve any or all disadvantages noted in the background.

SUMMARY

An ion pump includes an anode, a backing surface having at least one surface structure extending toward the anode and a cathode positioned between the anode and the backing surface and having an opening such that the at least one surface structure is aligned with the opening.

In a further embodiment, an ion pump includes an cylindrical anode having an opening and a cathode plate having an opening aligned with the opening of the cylindrical anode.

In a still further embodiment, a method includes applying a first potential difference between an anode and a cathode to move ions formed in a space near the anode toward the cathode. A second potential difference is applied between a post and the cathode to direct the ions as the ions move toward the cathode so as to cause the ions to strike the cathode.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION OF ILLUSTRATIVE EMBODIMENTS

Figure 1:
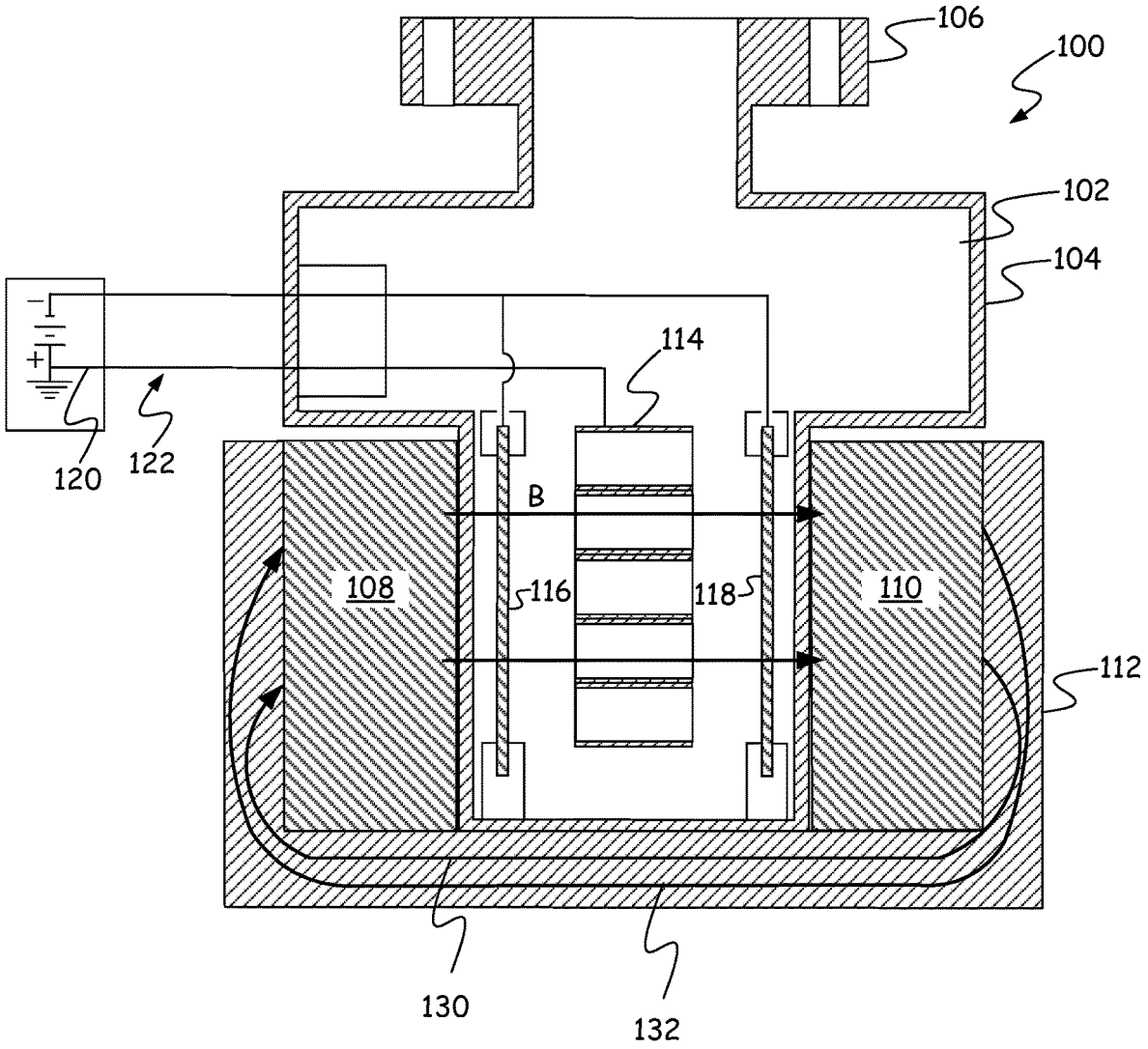
FIG. 1 provides a sectional view of an ion pump.

FIG. 1 provides a sectional view of an ion pump 100. Ion pump 100 includes a vacuum chamber 102 defined by a chamber wall 104 that is welded to a connection flange 106 for connection to a system to be evacuated. Two ferrite magnets 108 and 110 are located external to chamber wall 104 and are mounted on opposing sides of ion pump 100. A magnetic flux guide 112 is positioned on the outside of each of ferrite magnets 108 and 110 and extends below ion pump 100 to guide magnetic flux between the exteriors of each of the ferrite magnets 108 and 110 as shown by arrows 130 and 132. Ferrite magnets 108 and 110 produce a magnetic field B that passes through vacuum chamber 102. In accordance with some embodiments, the magnetic field has a strength of 1200 gauss (0.12 tesla).

Within vacuum chamber 102, an array of cylindrical anodes 114 is positioned between two cathode plates 116 and 118 such that the openings of each anode cylinder face the cathode plates.

The cylindrical anodes 114 and chamber wall 104 are maintained at ground potential while cathode plates 116 and 118 are maintained at a negative potential by an external power supply 120 that is connected to ion pump 100 by a power cable 122. In accordance with some embodiments, the potential difference between cylindrical anode 114 and cathode plates 116 and 118 is 7 kV.

In operation, flange 106 is connected to a flange of a system to be evacuated. Once connected, particles within the system to be evacuated travel into vacuum chamber 102 and eventually move within the interior of one of the cylindrical anodes 114. The combination of the magnetic field B and the electrical potential between anodes 114 and cathode plates 116 and 118 cause electrons to be trapped within each of the cylindrical anodes 114. Although trapped within the cylindrical anodes 114, the electrons are in motion such that as particles enter a cylindrical anode 114, they are struck by the trapped electrons causing the particles to ionize. The resulting positively charged ions are accelerated by the potential difference between anode 114 and the cathode plates 116 and 118 causing the positively charged ions to move from the interior of cylindrical anodes 114 toward one of the cathode plates 116 and 118.

Figure 2:
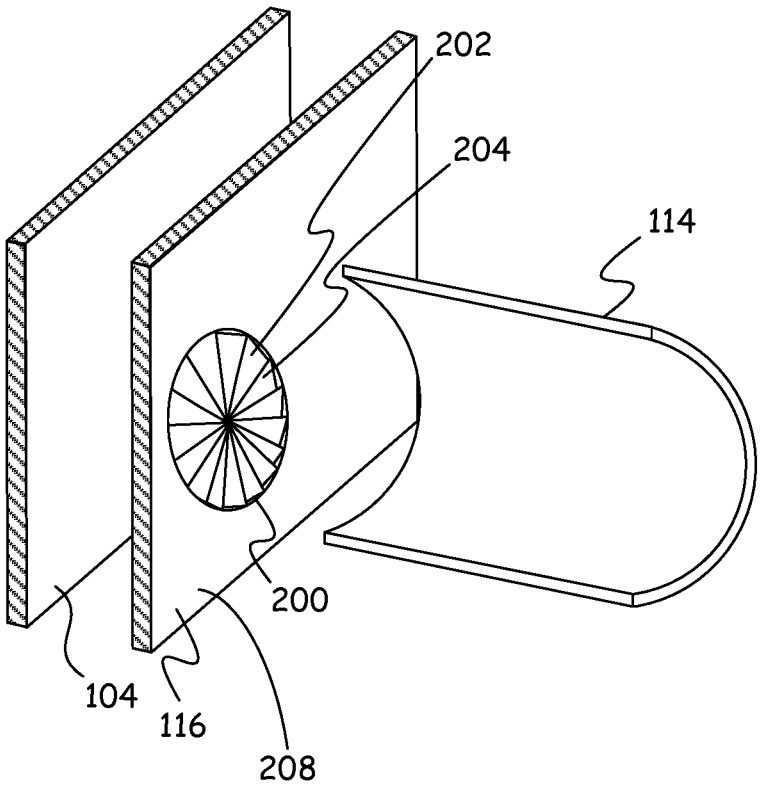
FIG. 2 (PRIOR ART)
FIG. 2 shows a perspective sectional view of a portion of a prior art ion pump.
Figure 3:
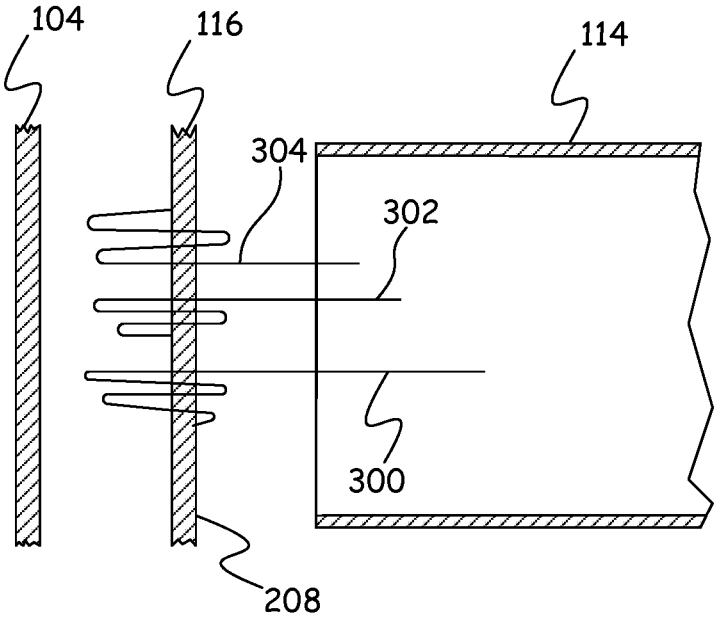
FIG. 3 (PRIOR ART)
FIG. 3 provides a side sectional view of the portion of the ion pump shown in FIG. 2.

FIGS. 2 and 3 provide a sectional perspective view and a side sectional view of a portion of an ion pump of the prior art. The portions shown in FIG. 2 show a single cylindrical anode 114, a portion of cathode plate 116 and a portion of chamber wall 104. As shown in FIG. 2, some cathode plates of the prior art included target areas 200 made up of angled faces, such as angled faces 202 and 204. The angled faces in target area 200 do not pass entirely through cathode plate 116, but instead were designed to change the angle at which the positive ions strike cathode plate 116. Without the angled surfaces, it was thought that the ions would strike the cathode plate at roughly 90°. By cutting the angled surfaces into cathode plate 116, it was thought that this angle could be reduced to something less than 90°.

In the art, it has been thought that all of the positively charged ions impact cathode plate 116 along surface 208 of cathode plate 116, which is the surface that faces cylindrical anodes 114. Specifically, it has been thought that the ions strike target 200 causing material from target 200 to sputter outwardly from cathode plate 116.

However, the present inventors have discovered that the positively charged ions do not always sputter upon reaching the cathode plate, but instead pass through the cathode plate as shown by paths 300, 302 and 304 of FIG. 3. As shown by these paths, once the positive ions reach the other side of cathode plate 116, they are influenced by the potential difference between chamber wall 104 and cathode plate 116 causing them to turn back toward cathode plate 116. Many of the returning particles pass through cathode plate 116 again and are then turned back toward cathode plate 116 by the electric field between anode cylinders 114 and cathode plate 116. Thus, some ions continue to oscillate back and forth through cathode plate 116 until finally sputtering.

These oscillations are inefficient because the accelerated particles do not immediately sputter. In addition, there is no control in the prior art over the angles at which the particles strike cathode plate 116. This lack of control results in inefficient sputtering because the amount of material sputtered by cathode plate 116 is dependent upon the angle at which the particles strike cathode plate 116. Since the impact angle cannot be controlled under the prior art, many of the ions strike the cathode plate at less than optimal sputtering angles.

In accordance with the various embodiments, structures are formed in chamber wall 104 and/or cathode plates 116 and 118 to form an electric field that controls the trajectory of particles accelerated toward the cathode plates so that the particles strike the cathode plates in an efficient manner and within a desired range of impact angles. In accordance with some embodiments, the structures include openings in the cathode plates 116, 118 that are aligned with the openings in the cylindrical anodes. In some embodiments, the structures further include surface structures or posts extending from vacuum chamber wall 104 toward the openings in the cathode plates. In particular, the surface structures and posts extend from a backing surface of vacuum chamber wall 104 toward the cathode plates. In accordance with one embodiment, the posts and backing surface are maintained at the same voltage as the cylindrical anodes 114 creating a voltage or potential difference between the surface structure/post and the cathode plates 116. This voltage difference results in an electric field that controls the trajectory of the ion particle moving toward the cathode plates so that the particles strike the cathode plate within a range of desired impact angles to cause efficient sputtering of the cathode plate material.

Figure 4:
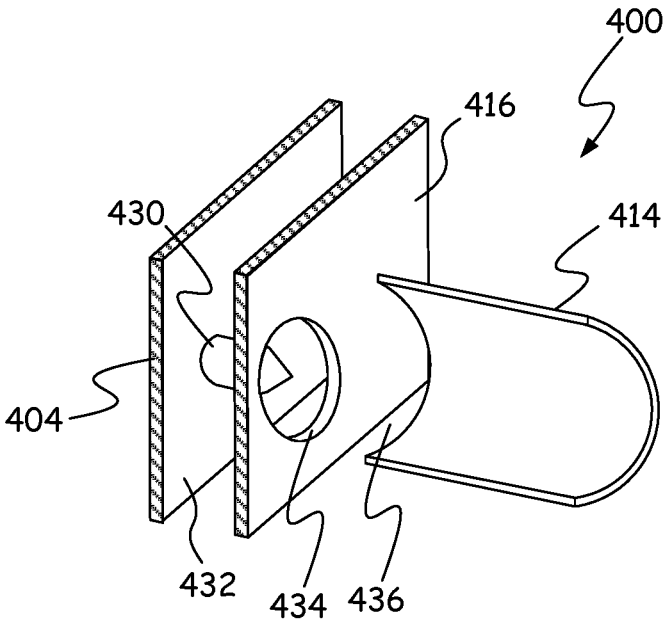
FIG. 4 shows a perspective sectional view of a portion of an ion pump in accordance with one embodiment.
Figure 5:
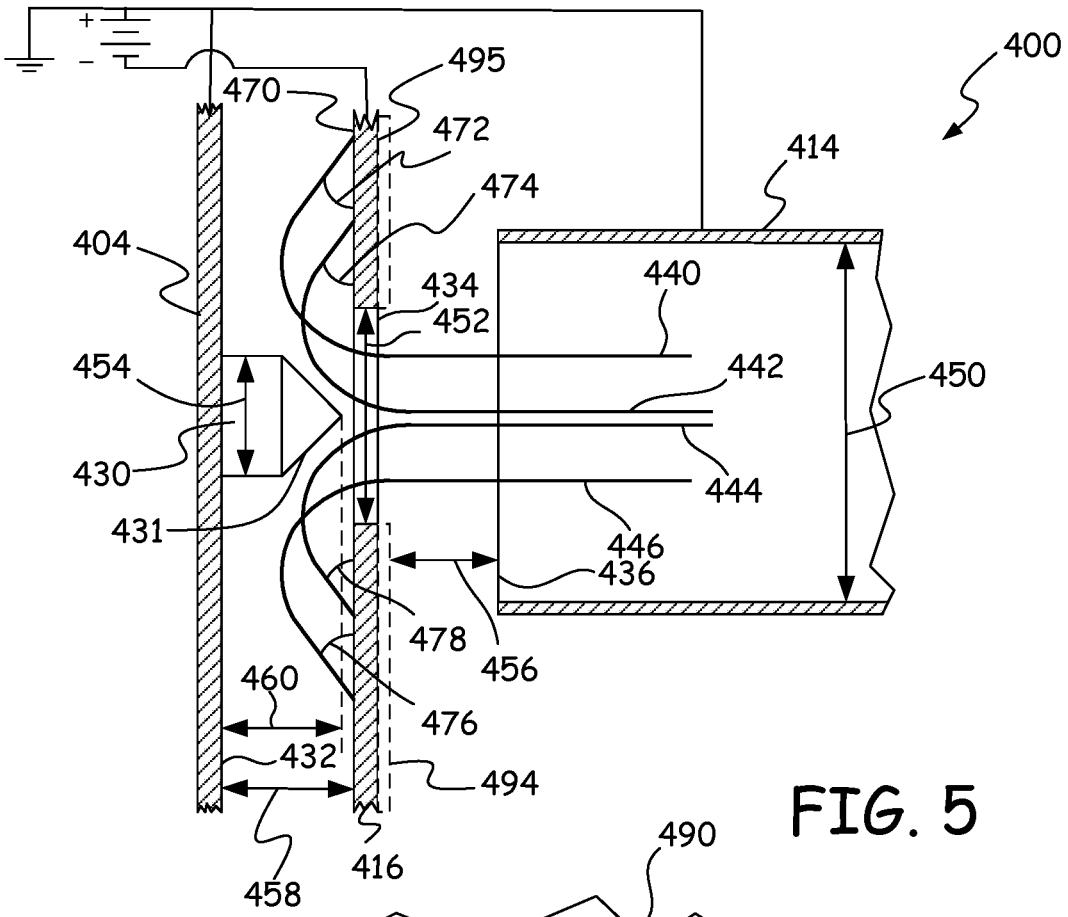
FIG. 5 shows a side sectional view of the portion of the ion pump shown in FIG. 4.

FIG. 4 provides a perspective sectional view of a portion of an ion pump 400 in accordance with one embodiment. FIG. 5 provides a side sectional view of the portion of ion pump 400 shown in FIG. 4. Ion pump 400 includes a cylindrical anode 414, a cathode plate 416 and a vacuum chamber wall 404. Cylindrical anode 414 includes an opening 436 that is aligned with an opening 434 in cathode plate 416. As shown in FIGS. 4 and 5, vacuum chamber wall 404 includes a backing surface 432 that faces cathode plate 416. A post 430 extends from backing surface 432 toward opening 434 in cathode plate 416 and thus toward cylindrical anode 414. In accordance with one embodiment, post 430 includes a conical tip 431 and is centered on the axis of opening 434 and the axis of opening 436 of cylindrical anode 414.

Cathode plate 416 is separated from cylindrical anode 414 by a distance 456, which is 6 mm in one embodiment, and cathode plate 416 is separated from backing surface 432 of vacuum chamber wall 404 by a distance 458, which is 6 mm in one embodiment. Opening 436 of cylindrical anode 414 has a diameter 450, which is 19 mm in one embodiment, opening 434 of cathode plate 416 has a diameter 452, which is 12.8 mm in one embodiment, and post 430 has a diameter 454, which is 6.4 mm in one embodiment. Post 430 extends a distance 460, which is 6 mm in one embodiment, from backing surface 432.

As shown in FIG. 5, a first electrical potential difference is applied between cylindrical anode 414 and cathode plate 416 a second electrical potential is applied between vacuum chamber wall 404/surface structure/post 430 and cathode plate 416. In FIG. 5, these two electrical potential differences are maintained at the same value by maintaining chamber wall 404, surface structure/post 403 and cylindrical anode 414 at a common voltage, such as ground, while cathode plate 416 is maintained at a negative voltage relative to vacuum housing wall 404, surface structure/post 430 and anode 414. In accordance with one embodiment, cathode plate 416 is maintained at −7 kV relative to vacuum housing wall 404, surface structure/post 430 and anode 414. In other embodiments the first electrical potential difference and the second electrical potential difference are different from each other.

The potential difference between cylindrical anode 414 and cathode plate 416 causes positively charged ions formed in a space near anode 414 to be accelerated toward cathode plate 416 along a trajectory path, such as trajectory paths 440, 442, 444 and 446. The shape and positions of post 430 and opening 434 as well as the potential difference between post 430 and cathode plate 416 forms an electric field that controls the trajectory of the positive ions along paths 440, 442, 444 and 446 such that the positively charged ions pass through opening 434 before turning along an arc and impacting a back surface 470 of cathode plate 416. In particular, the positive ions impact surface 470 at an impact angle such as impact angles 472, 474, 476 and 478. Each of these impact angles is within a range of impact angles centered about an ideal impact angle for maximizing sputtering of material from surface 470. Note that different ions will have different masses and thus will follow different paths and impact at different angles. However, when compared to the prior art, many more of the positively charged ions will impact surface 470 at an impact angle that is closer to an ideal impact angle for sputtering.

Figure 6:
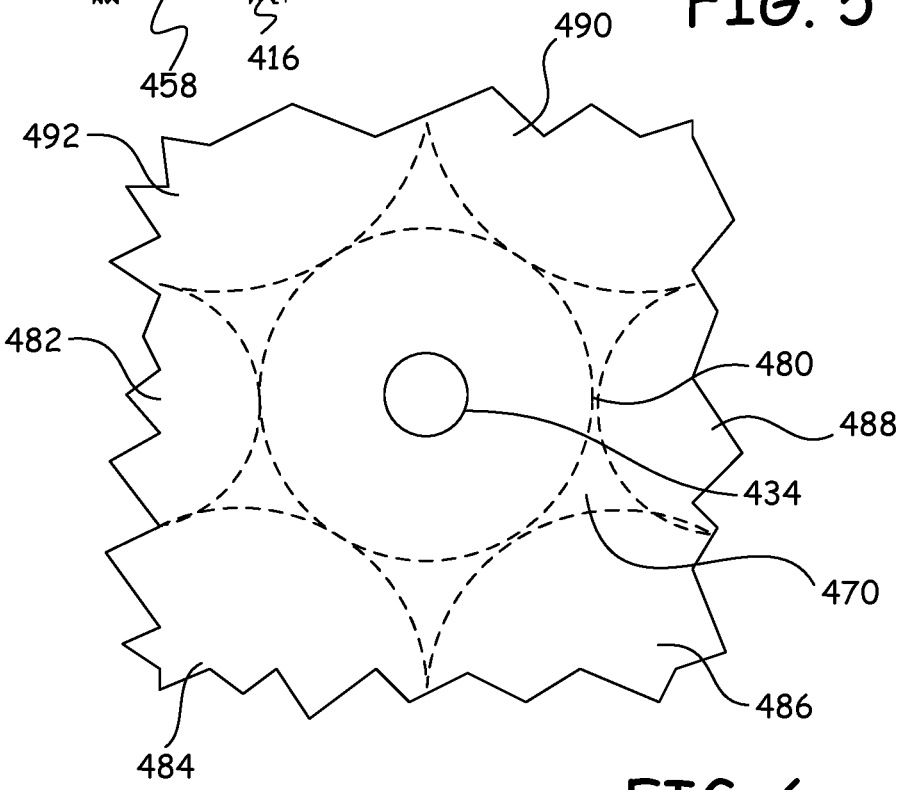
FIG. 6 shows a back view of the cathode plate of FIG. 5.

FIG. 6 provides a back view of cathode plate 416 showing surface 470. In FIG. 6, a circular impact area 480 is shown that is centered around opening 434 and represents the area where ions will impact cathode plate 416. Additional impact areas 482, 484, 486, 488, 490 and 492 for other openings like opening 434 (not shown) are also depicted in FIG. 6. Area 480 is generally larger than the impact area associated with prior art cathode plates and as such, the ions are better distributed in the various embodiments than in the prior art.

Because the positively charged ions are directed through opening 434, it is possible to add a Non-Evaporable Getter (NEG) layer 494 on a front surface 495 of cathode plate 416.

Front surface 495 faces cylindrical anode 414 and the NEG layer 494 acts as a getter that chemically reacts with uncharged particles to trap the particles and thereby improve the operation of the ion pump.

Figure 7:
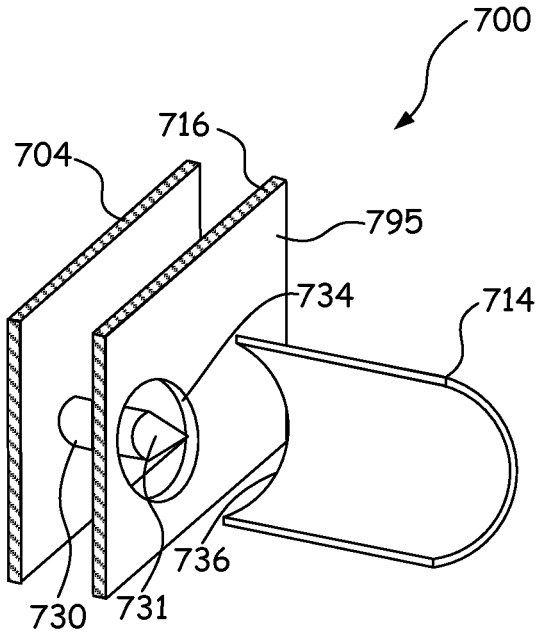
FIG. 7 shows a perspective sectional view of a portion of an ion pump in accordance with a second embodiment.
Figure 8:
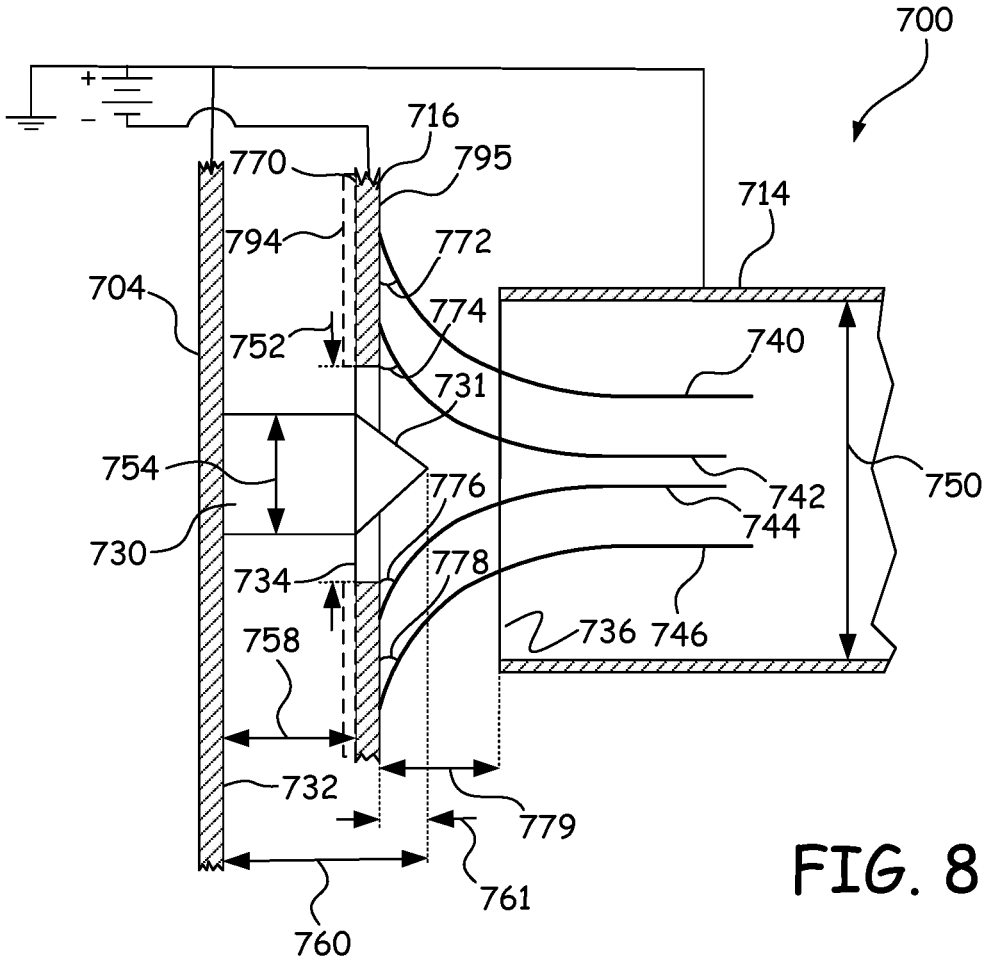
FIG. 8 shows a side sectional view of the portion of the ion pump shown in FIG. 7.

FIG. 7 provides a perspective sectional view and FIG. 8 provides a side sectional view of a portion of an ion pump 700 in accordance with a second embodiment. Ion pump 700 includes a cylindrical anode 714, a cathode plate 716 and a vacuum chamber wall 704. In the portion of ion pump 700, as shown in FIGS. 7 and 8, cylindrical anode 714 is positioned relative to cathode plate 716 such that an opening 736 of anode 714 faces cathode plate 716. An opening 734 in cathode plate 716 is coaxial with and thus aligned with opening 736 of cylindrical anode 714. A surface structure/post 730 having a conical tip 731 extends from a backing surface 732 of vacuum chamber wall 704, such that post 730 extends into and through opening 734 of cathode plate 716 and toward anode 714.

Cathode plate 716 is separated from cylindrical anode 714 by a distance 779, which is 6 mm in one embodiment, and cathode plate 716 is separated from backing surface 732 of vacuum chamber wall 704 by a distance 758, which is 6 mm in one embodiment. Opening 736 of cylindrical anode 714 has a diameter 750, which is 19 mm in one embodiment, opening 734 of cathode plate 416 has a diameter 752, which is 12.8 mm in one embodiment, and post 730 has a diameter 754, which is 6.4 mm in one embodiment. Post 730 extends a distance 760, which is 12.4 mm in one embodiment, from backing surface 732 and extends past surface 795 of cathode plate 716 by a distance 761, which is 3 mm in one embodiment.

As shown in FIG. 8, a first electrical potential difference is applied between cylindrical anode 714 and cathode plate 716 a second electrical potential is applied between vacuum chamber wall 704/surface structure/post 730 and cathode plate 716. In FIG. 8, these two electrical potential differences are maintained at the same value by maintaining chamber wall 704, surface structure/post 703 and cylindrical anode 714 at a common voltage, such as ground, while cathode plate 716 is maintained at a negative voltage relative to vacuum housing wall 704, surface structure/post 730 and anode 714. In accordance with one embodiment, the voltage on cathode plate 716 is 7 kV lower than the voltage on anode 714, vacuum chamber wall 704 and post 730. In other embodiments the first electrical potential difference and the second electrical potential difference are different from each other.

The potential difference between post 730 and cathode plate 716 and the potential difference between anode 714 and cathode plate 716 generates an electric field that causes positive ions formed in a space near anode 714 to accelerate toward cathode plate 716 and to move along a curved path, such as one of paths 740, 742, 744 and 746 of FIG. 8. These curved paths result in the positive ions impacting front surface 795 of cathode plate 716 at respective angles 772, 774, 776 and 778. Angles 772, 774, 776 and 778 fall within a range of angles centered on an ideal sputtering angle at which the amount of sputtered material from cathode plate 716 is maximized. Thus, the electric fields produced by anode 714, cathode plate 716 and post 730 control the trajectory of the ions formed in anode 714 to thereby improve the efficiency of sputtering in ion pump 700.

Figure 9:
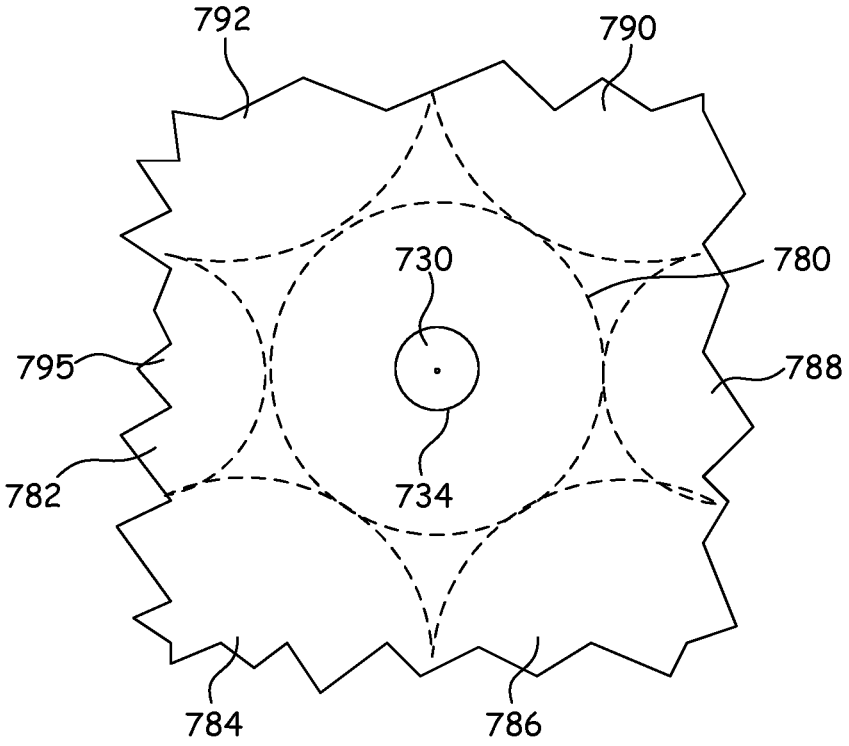
FIG. 9 shows a front view of the cathode plate of FIG. 8.

FIG. 9 shows a front view of cathode plate 716 showing surface 795, opening 734 and post 730. In FIG. 9, a circular impact area 780 is shown for ions guided by the electric field produced by post 730. Additional impact areas associated with other posts and openings are shown as impact areas 782, 784, 786, 788, 790 and 792.

Because post 730 and opening 734 direct ions to front surface 795 of cathode plate 716, back surface 770 is not impacted by ions. Because of this, a NEG layer 794 can be deposited on back surface 770 and can be used to getter particles that come between cathode plate 716 and vacuum chamber wall 704.

Although only one cylindrical anode, one opening in one cathode plate and one post are shown in the embodiments of FIGS. 4, 5, 7 and 8, those skilled in the art will recognize that in ion pumps 400 and 700 there is an array of cylindrical anodes and two cathode plates arranged on each side of the array of cylindrical anodes as shown in FIG. 1. Further, for each of the plurality of cylindrical anodes there is a corresponding opening in each of the two cathode plates in ion pumps 400 and 700. Thus, there is a plurality of openings in the cathode plates with each opening aligned with a respective opening in one of the plurality of cylindrical anodes. Additionally, for each opening in the cathode plates, there is a corresponding surface structure/post that extends toward and is aligned with the opening in the cathode plate and the corresponding opening in a respective cylindrical anode. For the embodiment of FIGS. 4 and 5, each of these posts extends short of the cathode plate. For the embodiments of FIGS. 7 and 8, each of these posts extends through the corresponding opening in the cathode plate.

Figure 10:
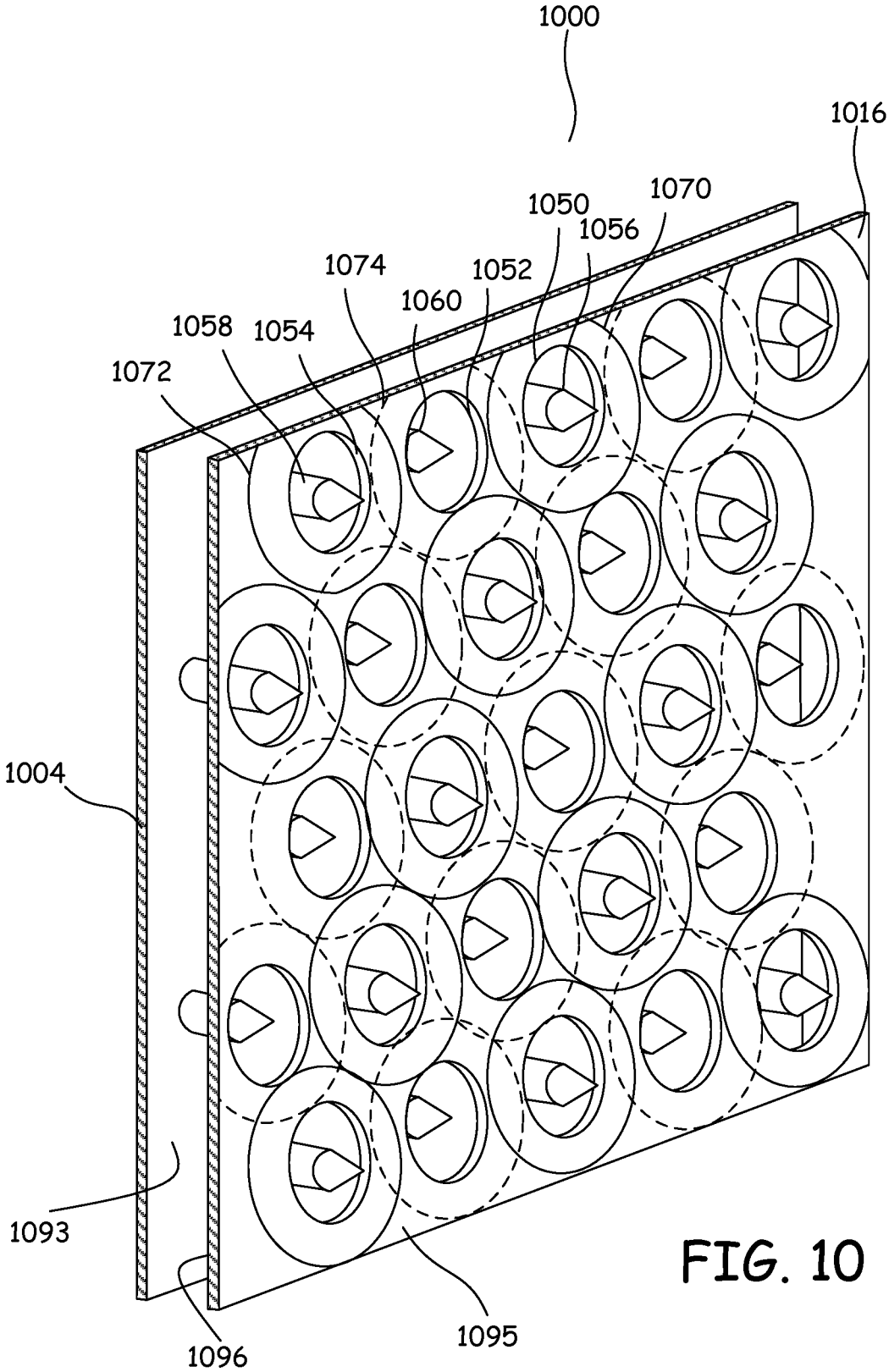
FIG. 10 shows a perspective view of a portion of an ion pump in accordance with a further embodiment.

FIG. 10 provides a perspective sectional view of a portion of a further embodiment of an ion pump 1000. In FIG. 10, a portion of a cathode plate 1016 and a portion of a vacuum chamber wall 1004 are shown. An array of surface structures/posts extends from a backing surface 1093 of vacuum chamber wall 1004 toward cathode plate 1016 and an array of anodes (not shown). In ion pump 1000 varying post lengths are used with some posts having a length, such as length 760, shown in FIG. 8, and other posts having a length, such as 460 of FIG. 5. Thus some of a plurality of surface structures extend further toward the cathode plate and a respective anode than others of the plurality of surface structures. In cathode plate 1016, there are a plurality of openings arranged in a close-packed formation, such as openings 1050, 1052 and 1054. For some of the openings, such as openings 1050 and 1054, posts, such as posts 1056 and 1058, extend through the opening and for other openings, such as opening 1052, post 1060 remains on the backside of cathode plate 1016 and does not pass through opening 1052. Thus, the embodiment of FIG. 10 is a combination of the embodiments of FIGS. 5 and 8.

Each of the openings in cathode plate 1016 is aligned with a cylindrical anode such that positively charged ions formed in the cylindrical anode are accelerated toward cathode plate 1016. For cases where the post extends through the opening, such as posts 1056 and 1058 extending through openings 1050 and 1054, the electric field generated by posts 1056, 1058, cathode plate 1016 and the associated cylindrical anode control the trajectory of the positively charged ions so that the ions strike front surface 1095 of cathode plate 1016 forming a circular impact area, such as impact areas 1070 and 1072. Similar impact areas are shown in solid circles in FIG. 10. For cases where the post does not pass into the opening, such as post 1060 and opening 1052, the electric field produced by post 1060, cathode plate 1016 and the associated cylindrical anode causes positively charged ions to be accelerated through the opening and to curve back toward back surface 1096 of cathode plate 1016 so that the positively charged ions impact back surface 1096 within a circular impact area, such as impact area 1074 for opening

1052. Similar impact areas on back surface 1096 are depicted by dotted line circles in FIG. 10. The arrays of post shown in FIG. 10 thus distribute the impact of ions both to the front and back of the cathode plate in a controlled manner forming efficient sputtering and making more efficient use of both surfaces of cathode plate 1016.

Although the present invention has been described with reference to preferred embodiments, workers skilled in the art will recognize that changes may be made in form and detail without departing from the spirit and scope of the invention.

What is claimed is:

1. An ion pump comprising:

an anode;

a backing surface having at least one surface structure extending toward the anode;

a cathode positioned between the anode and the backing surface and having an opening such that the at least one surface structure is aligned with and extends from the backing surface towards the opening and wherein the cathode is configured to be at a different electrical potential than the surface structure.

2. The ion pump of claim 1 wherein the anode comprises a cylinder and wherein the opening in the cathode is aligned with an opening in the cylinder.

3. The ion pump of claim 1 wherein the at least one surface structure extends into the opening in the cathode.

4. The ion pump of claim 1 further comprising a plurality of anodes, wherein the cathode further comprises a plurality of openings and wherein the backing surface further comprises a plurality of surface structures, each surface structure extending toward a respective anode and aligned with a respective opening in the cathode.

5. The ion pump of claim 4 wherein each of the plurality of anodes comprises a cylinder and wherein each opening in the cathode is aligned with a respective opening in one of the plurality of anodes.

6. The ion pump of claim 4 wherein some of the plurality of surface structures extend further toward the respective anode than others of the plurality of surface structures.

7. The ion pump of claim 1 further comprising a non-evaporative getter (NEG) material on a side of the cathode facing the anode.

8. The ion pump of claim 1 further comprising a non-evaporative getter (NEG) material on a side of the cathode facing the backing surface.

9. An ion pump comprising:

a cylindrical anode having an opening;

a cathode comprising a cathode plate having an opening aligned with the opening of the cylindrical anode such that the opening of the cathode plate is devoid of the cathode; and a post aligned with the opening in the cathode plate.

10. The ion pump of claim 9 wherein the post extends into the opening in the cathode plate.

11. The ion pump of claim 9 further comprising:

a plurality of cylindrical anodes, each having a respective opening;

wherein the cathode plate further comprises a plurality of openings each aligned with a respective opening in a respective one of the plurality of cylindrical anodes.

12. The ion pump of claim 11 further comprising a plurality of posts including the post, each post aligned with a respective opening in the cathode plate.

13. The ion pump of claim 12 wherein at least one post of the plurality of posts extends into a respective opening in the cathode plate.

14. The ion pump of claim 13 wherein at least one post of the plurality of posts extends toward the cathode plate further than another post of the plurality of posts extends toward the cathode plate.

15. The ion pump of claim 9 wherein one side of the cathode plate is coated with a non-evaporative getter (NEG) material.

* * * * *